US008359894B2

(12) United States Patent
Yoshii et al.

(10) Patent No.: US 8,359,894 B2
(45) Date of Patent: Jan. 29, 2013

(54) METHOD FOR COOLING HOT-ROLLED STEEL STRIP

(75) Inventors: Isao Yoshii, Tokyo (JP); Noriyuki Hishinuma, Tokyo (JP); Yoshiyuki Furukawa, Tokyo (JP); Satoru Ishihara, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/391,987

(22) PCT Filed: Dec. 16, 2010

(86) PCT No.: PCT/JP2010/072639

§ 371 (c)(1),
(2), (4) Date: Feb. 23, 2012

(87) PCT Pub. No.: WO2011/074632

PCT Pub. Date: Jun. 23, 2011

(65) Prior Publication Data

US 2012/0151981 A1 Jun. 21, 2012

(30) Foreign Application Priority Data

Dec. 16, 2009 (JP) ..... P2009-285121

(51) Int. Cl.
*B21B 37/74* (2006.01)

(52) U.S. Cl. ..... 72/201; 72/12.2; 72/342.2

(58) Field of Classification Search ..... 72/8.5, 72/11.3, 12.2, 200, 201, 342.2, 342.6
See application file for complete search history.

(56) References Cited

U.S. PATENT DOCUMENTS 3,604,234 A 9/1971 Hinrichsen et al.
7,310,981 B2 * 12/2007 Kurz et al. ..... 72/201

FOREIGN PATENT DOCUMENTS

| | | | |
|---|---|---|---|
| DE | 25 07 641 | A1 | 9/1976 |
| JP | 1-312031 | A | 12/1989 |
| JP | 3-198905 | A | 8/1991 |
| JP | 3-277721 | A | 12/1991 |
| JP | 7-16635 | A | 1/1995 |
| JP | 8-252625 | A | 10/1996 |
| JP | 9-85328 | A | 3/1997 |
| JP | 9-216011 | A | 8/1997 |

(Continued)

OTHER PUBLICATIONS

International Search Report, dated Mar. 8, 2011, cited in PCT/JP2010/072639.
European Search Report dated Aug. 31, 2012 issued in corresponding European patent application No. 10837657.5.
Notice of Allowance mailed Sep. 12, 2012 in Korean Patent Application No. 10-2012-7005427 (English translation is attached).

*Primary Examiner* — Teresa M Ekiert
(74) *Attorney, Agent, or Firm* — Birch Stewart Kolasch & Birch, LLP

(57) ABSTRACT

The present invention provides a method for cooling a hot-rolled steel strip after a finishing rolling in which a transportation speed varies, the method including: setting a transportation-speed changing schedule on the basis of a temperature of a steel strip before the finishing rolling and a condition of the finishing rolling; performing a first cooling in which the hot-rolled steel strip is cooled under a film boiling state in a first cooling section; performing a second cooling in which the hot-rolled steel strip is cooled with a water amount density of not less than $2m^3/min/m^2$ in a second cooling section; and coiling the hot-rolled steel strip, in which a cooling condition is controlled in the first cooling so as to satisfy $0.8 \leqq (T2a' - T2a)/\Delta Tx \leqq 1.2$.

19 Claims, 7 Drawing Sheets

FOREIGN PATENT DOCUMENTS

| | | | |
|---|---|---|---|
| JP | 10-5845 | A | 1/1998 |
| JP | 2001-246410 | A | 9/2001 |
| JP | 2003-145212 | A | 5/2003 |
| JP | 2005-36308 | A | 2/2005 |
| JP | 2008-290156 | A | 12/2008 |
| JP | 2009-56504 | A | 3/2009 |
| JP | 4449991 | B2 | 4/2010 |
| WO | WO 2010/131467 | A1 | 11/2010 |

* cited by examiner

METHOD FOR COOLING HOT-ROLLED STEEL STRIP

TECHNICAL FIELD

The present invention relates to a method for cooling a hot-rolled steel strip. The present application claims priority based on Japanese Patent Application No. 2009-285121 filed in Japan on Dec. 16, 2009, the contents of which are incorporated herein by reference.

BACKGROUND ART

In a hot-rolling process, a hot-rolled steel strip which has passed through a finishing rolling process (hereinafter, also referred to as "steel strip") is transported from a finishing rolling mill to a down coiler. During this transportation, the steel strip is cooled to a predetermined temperature by means of a cooling device formed by plural cooling units, and then, is coiled by the down coiler. At the time of hot-rolling the steel strip, the cooling manner of the steel strip after passing through the finishing rolling process to the coiling is an important factor in determining mechanical properties of the steel strip. In general, the steel strip is cooled, for example, by using water as a cooling medium (hereinafter, also referred to as "cooling water"). In recent years, the cooling is carried out in a high temperature range at a high cooling speed (hereinafter, also referred to as "rapid cooling"), for the purpose of maintaining workability and strength more than or equal to those of the conventional steel strip while reducing additional elements such as manganese in the steel strip. Further, from the viewpoint of maintaining the uniformity of cooling, there is known a method of cooling, which avoids the cooling in a state of transition boiling, which is a primary factor of non-uniformity in cooling, as much as possible, and employs cooling in a state of nucleate boiling, under which a stable cooling capability can be obtained. In general, the cooling in the state of nucleate boiling is the rapid cooling.

In the finishing rolling process, an accelerated rolling and a decelerated rolling are widely employed. A transportation speed of the steel strip on the output side of the finishing rolling mill is equal to a transportation speed up to the down coiler, and the steel strip is cooled in a state where the transportation speed changes. Therefore, in general, when the hot-rolled steel strip is cooled using rapid cooling, the cooling length and the water amount density of the cooling water are changed in accordance with an increase or decrease in the transportation speed of the steel strip, in order to achieve a target coiling temperature of the steel strip. For example, Patent Document 1 discloses a method of cooling in which, after the final finishing rolling milling, the length of the cooling zone is adjusted in accordance with an increase or decrease in the rolling speed of a hot-rolled steel plate such that the amount of decrease in temperature of the steel plate is constant within the steel plate. This method includes: a rapid cooling step of rapidly cooling the steel plate under a condition of a water amount density of 1000 L/min/$m^2$ or more; and a slow cooling step of slowly cooling the hot-rolled steel plate after the rapid cooling step such that the steel plate is coiled at a predetermined coiling temperature of the steel plate.

Further, Patent Document 2 discloses a technique in which cooling water with a water amount density of 2.0 $m^3/m^2$min or more is supplied, and the length of a cooling zone is adjusted by independently switching ON-OFF each cooling header of a first cooling header group and a second cooling header group in accordance with an increase in the transportation speed.

Related Art Document

Patent Documents

Patent Document 1: Japanese Unexamined Patent Application, First Publication No. 2008-290156

Patent Document 2: Japanese Patent Publication No. 4449991

DISCLOSURE OF THE INVENTION

Problems to be Solved by the Invention

However, with the invention described in Patent Document 1, it was found that, in the case where the length of cooling performed by the cooling device was changed in accordance with a change in transportation speed of the hot-rolled steel strip by, for example, controlling opening and closing of valves provided in the cooling device, the amount of cooling of the steel strip changed greatly in accordance with an increase or decrease in the length of cooling, causing the temperature of the steel strip after the rapid cooling to significantly change. Therefore, even if the supply of water is controlled in the cooling process thereafter, deviations of the temperatures of the steel strip occurring in the rapid cooling process cannot be prevented, whereby it is extremely difficult to control the coiling temperature of the steel strip within the target range of the temperature of the steel strip.

Further, it was also found that, in the case where part of the rapid cooling process was performed with air cooling at the time when the supply of water was controlled in the rapid cooling process, for example, by closing some of the valves for supplying the cooling water, the cooling water entered the air-cooled area from another water-supplying area, which is a main factor in causing non-uniformity of cooling. It may be possible to solve the problem described above, for example, by increasing the number of drainage units in the cooling device to prevent the cooling water from entering the area to be air-cooled. However, in the case of rapid cooling requiring a large amount of cooling water, a water drainage facility is required to have high capability, and hence, this method is not desirable because of installation limitations and cost.

In the case where the technique described in Patent Document 2 was employed in a state where the transportation speed of the hot-rolled steel strip changes under the transition boiling state where the capacity to cool the steel strip changes greatly, it was found that the deviation of the coiling temperature of the steel strip increased for the reason described above.

The present invention has been made in view of the reasons described above, and an object of the present invention is to provide a method for cooling a hot-rolled steel strip capable of; in cooling the hot-rolled steel strip after the finishing rolling in the hot rolling process, precisely and uniformly cooling the hot-rolled steel strip transported from the finishing rolling mill at a transportation speed with acceleration and deceleration to a predetermined coiling temperature of the steel strip.

Means for Solving the Problems

The present invention employs the following methods for solving the problems described above.

(1) A first aspect of the present invention provides a method for cooling a hot-rolled steel strip after a finishing rolling in which a transportation speed varies, the method including: setting a transportation-speed changing schedule based on a temperature of a steel strip before the finishing rolling and a condition of the finishing rolling; performing a first cooling in which the hot-rolled steel strip is cooled under a film boiling state in a first cooling section; performing a second cooling in which the hot-rolled steel strip is cooled with a water amount density of not less than 2 $m^3/min/m^2$ in a second cooling section; and coiling the hot-rolled steel strip. In this method, a cooling condition is controlled in the first cooling such that a target temperature T2*a* of the steel strip on an input side in the second cooling section before a change in a transportation speed, a target temperature T2*a*' of the steel strip on an input side in the second cooling section after a change in the transportation speed, and a change amount ΔTx of an amount of cooling of the hot-rolled steel strip in the second cooling section, the change amount being caused by the change in the transportation speed, satisfy $$0.8 \leqq (T2a' - T2a)/\Delta Tx \leqq 1.2 \quad \text{(Equation 1).}$$

(2) According to the method for cooling a hot-rolled steel strip of (1) above, a range of variation in a cooling length in the second cooling section may be in the range of 90% to 110% independently of a change in the transportation speed.

(3) According to the method for cooling a hot-rolled steel strip of (1) or (2) above, a range of variation in the water amount density in the second cooling section may be in the range of 80% to 120% independently of a change in the transportation speed.

(4) According to the method for cooling a hot-rolled steel strip of any one of (1) to (3) above, cooling under a nucleate boiling state accounts for not less than 80% of cooling duration in the second cooling section.

(5) According to the method for cooling a hot-rolled steel strip of any one of (1) to (4) above, the method may further include: performing a third cooling in a third cooling section disposed after the second cooling section, the third cooling being formed by cooling with a cooling water of a water amount density of not less than 0.05 $m^3/min/m^2$ and not more than 0.15 $m^3/min/m^2$ and cooling with outside air.

(6) According to the method for cooling a hot-rolled steel strip of any one of (1) to (5) above, the method may further include: setting a cooling length in the second cooling section based on a maximum value of the transportation speed in the transportation-speed changing schedule; and setting the target temperature T2*a* of the steel strip on the input side in the second cooling section based on a minimum value of the transportation speed in the transportation-speed changing schedule.

(7) According to the method for cooling a hot-rolled steel strip of any one of (1) to (6), the method may further include: measuring an input-side temperature of the steel strip on the input side in the second cooling section; and changing the cooling condition in the first cooling section based on the measured input-side temperature of the steel strip, and controlling the input-side temperature of the steel strip so as to fall within a predetermined range.

(8) According to the method for cooling a hot-rolled steel strip of any one of (1) to (7) above, the method may further include: measuring an output-side temperature of the steel strip on the output side in the second cooling section; and changing a cooling condition in a third cooling section disposed after the second cooling section on the basis of the measured output-side temperature of the steel strip, and controlling a coiling temperature of the steel strip to fall within a predetermined range.

(9) According to the method for cooling a hot-rolled steel strip of any one of (1) to (8) above, the second cooling section may include a front cooling section, a middle cooling section, and a rear cooling section, and the method may further include: measuring an output-side temperature of the steel strip on an output side of the front cooling section; and changing a cooling condition in the middle cooling section based on the measured output-side temperature of the steel strip in the front cooling section, and controlling the temperature of the steel strip on an input side of the rear cooling section to fall within a predetermined range.

EFFECTS OF THE INVENTION

According to the method described in (1) above, it is possible to suppress the variation in cooling caused by an increase/decrease in the cooling length and flow of the cooling water on the steel strip. In particular, it is possible to suppress the variation in cooling in the temperature range of the steel strip (from 300° C. to 700° C.) corresponding to the transition boiling state and the nucleate boiling state where the cooling capacity (cooling speed) sharply changes by controlling the cooling condition in the first cooling step so as to satisfy Equation 1 above in accordance with the change in the transportation speed, and setting the cooling condition in the second cooling step to be approximately constant.

According to the method described in (2) above, it is possible to suppress the variation in cooling caused by the flow of the cooling water on the steel strip and to suppress the deviation of the coiling temperature of the steel strip, by limiting the range of variation in the cooling length in the second cooling section.

According to the method described in (3) above, it is possible to suppress the variation in the cooling capacity (cooling speed) in the second cooling section and to suppress the deviation of the coiling temperature of the steel strip, by limiting the range of variation of the cooling water amount density.

According to the method described in (4) above, since it is possible to minimize the variation in cooling caused by the cooling under the transition boiling state and to suppress the deviation of the temperature of the steel strip on the output side in the second cooling section, it is possible to suppress the deviation of the coiling temperature of the steel strip.

According to the method described in (5) above, it is possible to suppress the deviation of the coiling temperature of the steel strip, by reducing the cooling water amount density in a section from the output side of the second cooling section to the coiling.

According to the method described in (6) above, since the temperature of the steel strip on the input side in the second cooling section is appropriately adjusted on the basis of the transportation-speed changing schedule, it is possible to favorably suppress the deviation of the coiling temperature of the steel strip.

According to the method described in any one of (7) to (9) above, it is possible to further favorably suppress the coiling temperature of the steel strip, by performing the feed-forward control and the feedback control based on the actually measured steel strip temperatures.

EMBODIMENTS OF THE INVENTION

The present inventors found that, at the time when a hot-rolled steel strip that has passed through a finishing rolling is cooled at least through a first cooling step and a second cooling step, which is a step of a rapid cooling, in a hot-rolling process in which a transportation speed varies, it is possible to suppress deviation of coiling temperatures of the steel strip by controlling the supply of water in the first cooling step so as to make cooling conditions such as cooling length and water amount density unchanged as much as possible in the second cooling step independently of change in the transportation speed, even when the transportation speed of the hot-rolled steel strip varies. More specifically, the present inventors found that it is possible to suppress the deviation of coiling temperature of the steel strip by controlling the cooling conditions in the first cooling step so as to satisfy:

$$0.8 \leqq (T2a' - T2a)/\Delta Tx \leqq 1.2 \quad \text{(Equation 1)},$$

where T2*a* is a target temperature of the hot-rolled steel strip on the input side in a second cooling section before the transportation speed varies; T2*a*' is a target temperature of the hot-rolled steel strip on the input side in the second cooling section after the transportation speed varies; and ΔTx is the amount of change in the amount of cooling of the hot-rolled steel strip in the second cooling section, the change being due to the occurrence of the change in rolling speed.

Hereinbelow, with reference to the drawings, a description will be made of a cooling device 1 and a method for cooling a steel strip S according to an embodiment of the present invention based on the findings described above.

Figure 1:
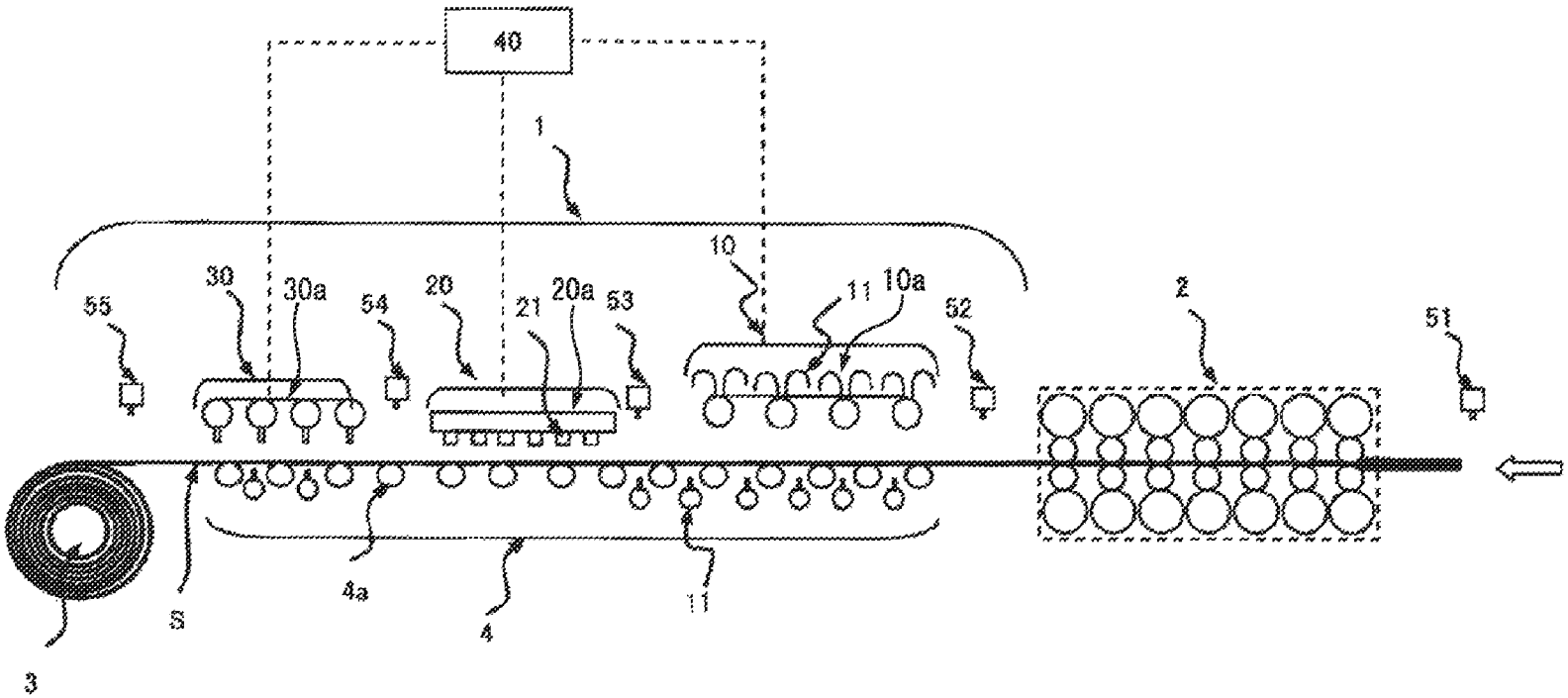
FIG. 1 is a diagram schematically illustrating a configuration of a finishing rolling mill and thereafter a hot-rolling facility having a cooling device according to an embodiment.

FIG. 1 schematically illustrates a configuration of a finishing rolling mill 2 and thereafter a hot-rolling facility having the cooling device 1 according to this embodiment.

As illustrated in FIG. 1, the hot-rolling facility includes the finishing rolling mill 2, a cooling device 1, and a coiler 3, which are disposed in this order in the transportation direction of the steel strip S. The finishing rolling mill 2 continuously rolls the steel strip S that has been discharged from a heating furnace (not shown) and has been rolled by a rough-rolling mill (not shown) with the continuous rolling being accelerated or decelerated in accordance with a transportation-speed changing schedule. The cooling device 1 cools the steel strip S after a finishing rolling to a predetermined coiling temperature of the steel strip of, for example, 300° C. The coiler 3 coils the cooled steel strip S. A thermometer 51 for measuring a finishing-rolling temperature T0 of the steel strip is provided on the upstream side of the finishing rolling mill 2, and a run-out table 4 formed by table rolls 4*a* is provided between the finishing rolling mill 2 and the coiler 3. The steel strip S that has been rolled by the finishing rolling mill 2 is cooled by the cooling device 1 while being transported on the run-out table 4, and then, is coiled by the coiler 3.

A first cooling unit 10*a* that cools, in a first cooling section 10, the steel strip S immediately after passing through the finishing rolling mill 2 is provided on the upstream side in the cooling device 1, in other words, at a position immediately downstream of the finishing rolling mill 2. As illustrated in FIG. 1, the first cooling unit 10*a* is provided with plural laminar nozzles 11 that spray the cooling water, for example, onto a surface of the steel strip S, the laminar nozzles being arranged in the width direction and the transportation direction of the steel strip S. The water amount density of the cooling water sprayed from the laminar nozzles 11 onto the surface of the steel strip S is set, for example, to 0.3 $m^3/m^2$/min. The first cooling section 10 refers to a section in which the steel strip S is cooled under a film boiling state by the first cooling unit 10*a*. In addition to spraying the cooling water through the laminar nozzles, cooling in the first cooling section 10 may be performed, for example, by spraying the cooling water by a spray nozzle, by gas cooling using an air nozzle, by combination of gas and water using a gas-water nozzle (mist cooling), or by air cooling in which no cooling medium is supplied. Note that the "cooled under a film boiling state" includes a cooling state where cooling in the film boiling range is performed in a part of the first cooling section while air-cooling is performed in the remainder of the section, in addition to a state where cooling under the film boiling state is performed in the entire first cooling section.

As illustrated in FIG. 1, on the downstream side of the first cooling unit 10*a*, there is provided a second cooling unit 20*a* that rapidly cools, in the second cooling section 20 (rapid cooling section), the steel strip S that has been cooled in the first cooling section 10. The second cooling section 20 refers to a section in which the second cooling unit 20*a* cools the steel strip S. The term "rapidly cools" as used in this embodiment refers to a cooling process in which the cooling water amount density is set at least to 2 $m^3/min/m^2$ or more, desirably to 3 $m^3/min/m^2$ or more. The term "cooling water amount density" means the amount of cooling water supplied per unit 1 $m^2$ on the target surface of the steel strip, and in the case of cooling only the upper surface of the steel strip, means the amount of cooling water supplied per unit 1 $m^2$ on the upper surface of the steel strip. The second cooling unit 20*a* is provided, for example, with spray nozzles 21 that spray the cooling water onto the upper surface of the steel strip S while being arranged in the transportation direction and the width direction of the steel strip, and has a capability to provide the cooling water amount density, for example, of 2 $m^3/min/m^2$, desirably of 3 $m^3/m^2/min$ or more to the steel strip S. With respect to the entire cooling mode in this second cooling section, the second cooling unit 20*a* has a capability to cool 80% or more of the cooling duration in the second cooling section under the nucleate boiling.

Figure 3:
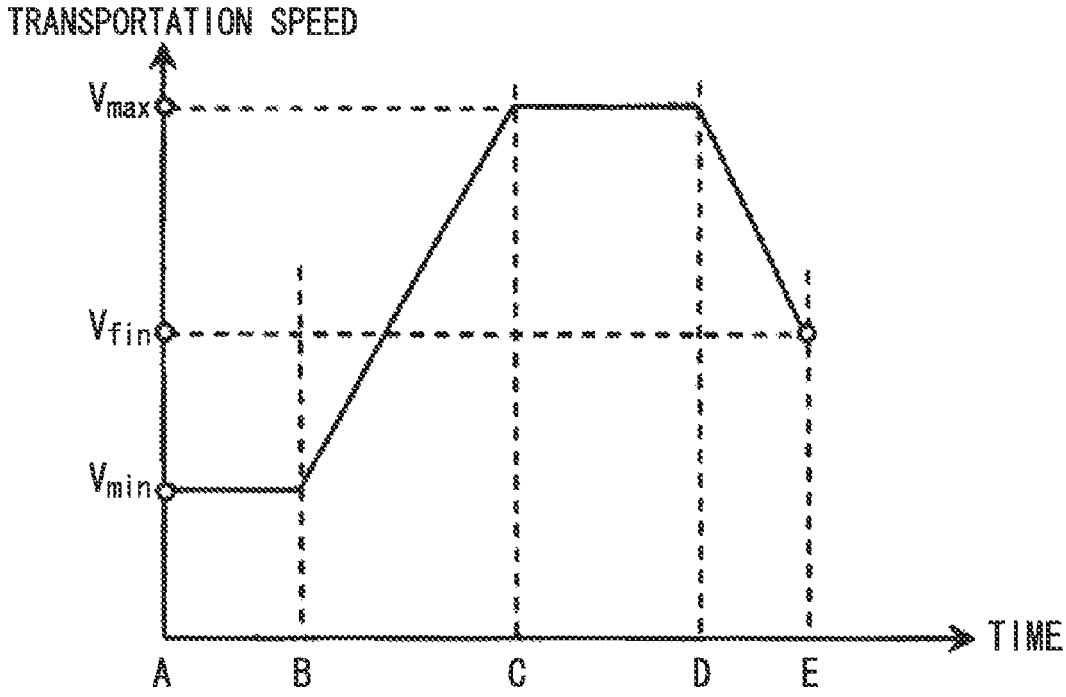
FIG. 3 is a schematic view illustrating an example of a transportation-speed changing schedule.
Figure 4:
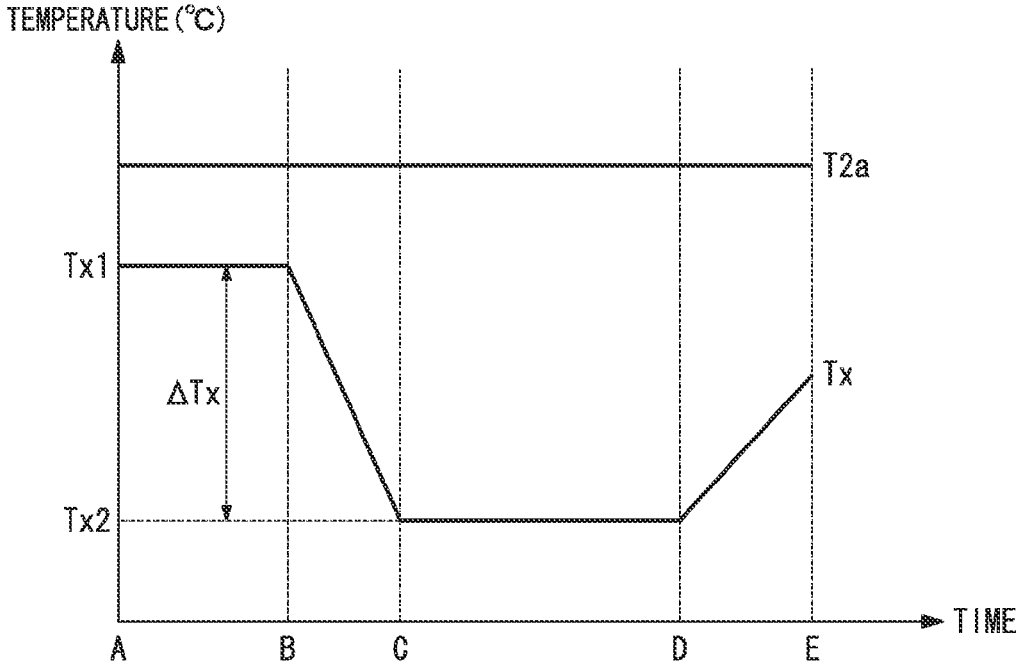
FIG. 4 is a schematic view of a temperature history during a cooling process.

As illustrated in FIG. 3, a third cooling unit 30*a* that cools a third cooling section 30 may be provided on the downstream side of the second cooling unit 20*a*. Similar to the first cooling unit 10*a*, the third cooling unit 30*a* is provided with plural laminar nozzles 11 that spray the cooling water onto the surface of the steel strip S while being arranged in the width direction and the transportation direction of the steel strip S. The water amount density of the cooling water sprayed from the laminar nozzles 11 onto the surface of the steel strip S is set, for example, to 0.3 $m^3/m^2/min$. In addition to by spraying the cooling water through the laminar nozzles, cooling in the third cooling section 30 may be performed, for example, by spraying the cooling water by a spray nozzle, by gas cooling using an air nozzle, by combination of gas and water using a gas-water nozzle (mist cooling), or by air cooling in which no cooling medium is supplied.

Thermometers 52, 53 for measuring an input-side steel strip temperature and an output-side steel strip temperature are provided on the input side and the output side of the first cooling section 10, respectively. Further, a thermometer 54 for measuring an output-side steel strip temperature is provided on the output side of the second cooling section 20. A thermometer 55 for measuring a coiling temperature of the steel strip is provided on the upstream side of the coiler 3. The temperatures of the steel strip at the time of cooling the steel strip are measured on an as-needed basis, and feed-forward control and feedback control are performed in the first cooling section 10 and the third cooling section 30 on the basis of the measured values from the thermometers.

Next, with reference to FIG. 2 to FIG. 6, a description will be made of a method for cooling the hot-rolled steel strip S according to this embodiment, the method at least including a first cooling step, a second cooling step, and a coiling step. Note that the description will be made on the assumption that the third cooling unit 30*a* is provided.

Figure 2:
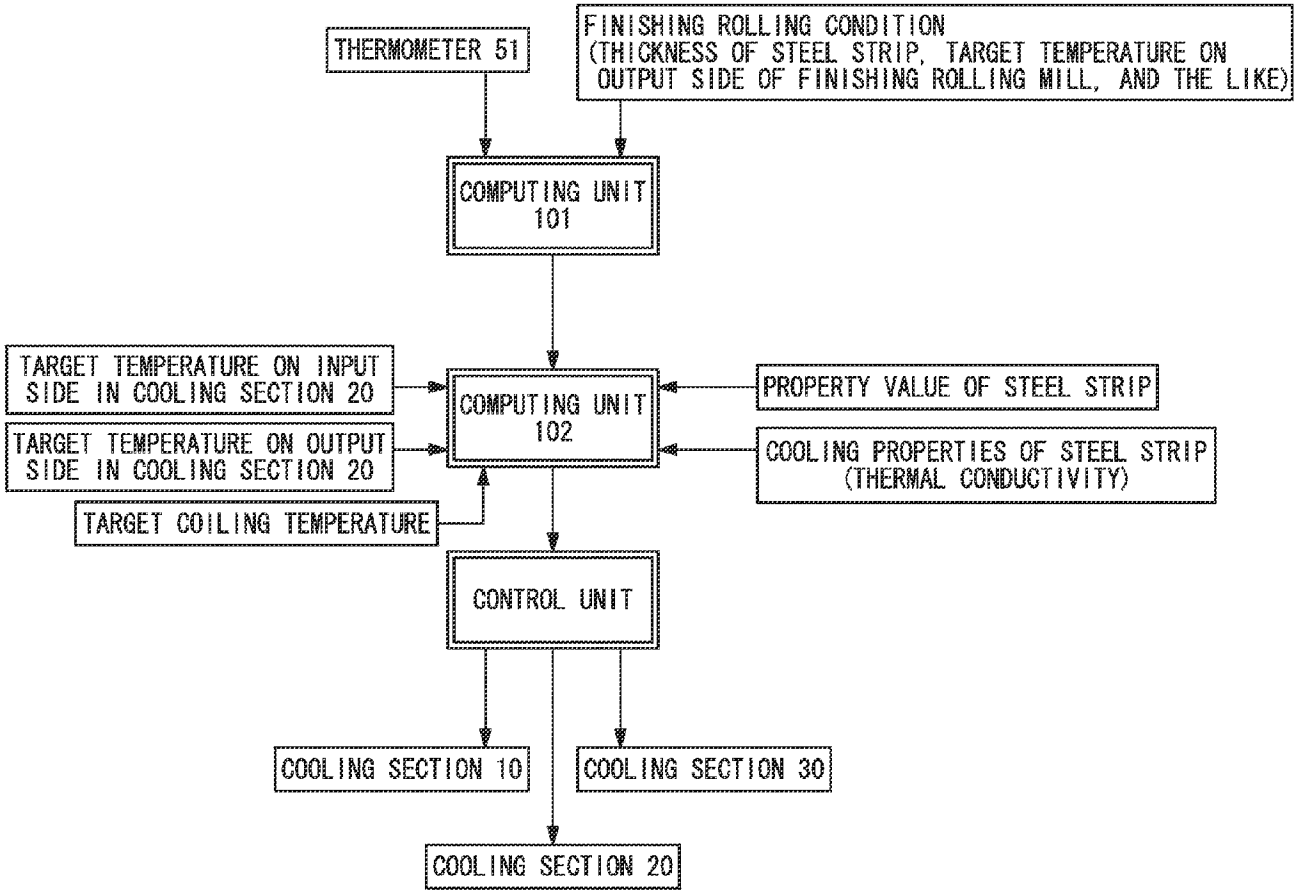
FIG. 2 is a diagram schematically illustrating a flow for determining cooling conditions.

FIG. 2 illustrates a flow of determining cooling conditions in the second cooling section 20 at the time of starting the cooling of the hot-rolled steel strip.

The steel strip after completion of rough rolling is transported to the finishing rolling mill 2, and the finishing-rolling steel strip temperatures thereof are measured by the thermometer 51. Data of the measured temperatures are input to a computing unit 101. On the basis of the temperatures of the steel strip and a predetermined finishing rolling condition such as thickness, which has been input in advance, the computing unit 101 obtains a transportation-speed changing schedule (speed on the output side of the finishing rolling mill) at positions in the longitudinal direction of the steel strip in a manner that the transportation-speed changing schedule satisfies the predetermined finishing rolling condition, as illustrated in FIG. 3. The transportation-speed changing schedule may be obtained so as to be associated with positions in the longitudinal direction of the steel strip, in addition to with time from the start of the finishing rolling.

The transportation-speed changing schedule obtained by the computing unit 101 is sent to a computing unit 102. The computing unit 102 sets, for example, the cooling conditions such as the cooling water amount density and the cooling length in the second cooling section 20, and an initial cooling condition in the first cooling section 10, which are necessary for adjusting the respective temperatures of the steel strip so as to fall within the target range, on the basis of the transportation-speed changing schedule, a target coiling temperature 4 of the steel strip, which has been input in advance, the input-side target steel strip temperature T2*a* and the output-side target steel strip temperature T2*b* in the second cooling section 20 and the like. Since the cooling capacity (cooling speed) can be expressed as a function of water amount density, it is possible to set the necessary water amount density and cooling length by obtaining the time required for passing through the cooling section on the basis of the transportation-speed changing schedule. Certain steel types are desirable to be cooled at a predetermined cooling speed for the purpose of improving the properties of the steel. For such steels, the necessary cooling length can be obtained on the basis of the water amount density required for the necessary cooling speed and the transportation-speed changing schedule. In a similar manner, it is possible to set the initial cooling conditions in the first cooling section 10 and the third cooling section 30 on the basis of the target coiling temperature T4 of the steel strip, the target steel strip temperature T2*b* on the output side in the second cooling section, the target steel strip temperature T2*a* on the input side in the second cooling section and the target steel strip temperature T0*a* on the output side of the finishing rolling.

In the continuous cooling process in the first cooling section 10 and the third cooling section 30, the cooling conditions such as the water amount density and the cooling length are changed by controlling the supplying of water so as to be associated with the change in the transportation speed. More specifically, by setting the target temperature T2*a*' of the steel strip on the input side in the second cooling section at the time when the transportation speed reaches the second transportation speed in a manner that satisfies the Equation 1 described above, the water supplying is controlled in the first cooling section so as to be able to achieve this setting value of the target steel strip temperature during the process transitioning from the first transportation speed to the second transportation speed. For example, in FIG. 3, it is assumed that the transportation speed at time B is set to the first transportation speed, and the transportation speed at time C is set to the second transportation speed. For example, in the case where the target coiling temperature T4 of the steel strip is 450° C., the target temperature T2*b* of the steel strip on the output side in the second cooling section 20 is set to 480° C., and the target temperature T2*a* of the steel strip on the input side in the second cooling section 20 is set to 600° C. as the cooling conditions at the first transportation speed. At the time of setting the T2*a* and the T2*b*, the cooling capacities in the first cooling section 10, the second cooling section 20 and the third cooling section 30, the start temperature of the transition boiling range of the steel strip and the like are taken into consideration. Of the setting values described above, the amount of cooling of the steel strip in the second cooling section 20 at the first transportation speed is T2*a*−T2*b*=120° C., and the cooling conditions such as the cooling length and the water amount density in the second cooling section are determined so as to be able to achieve the equation.

Figure 5:
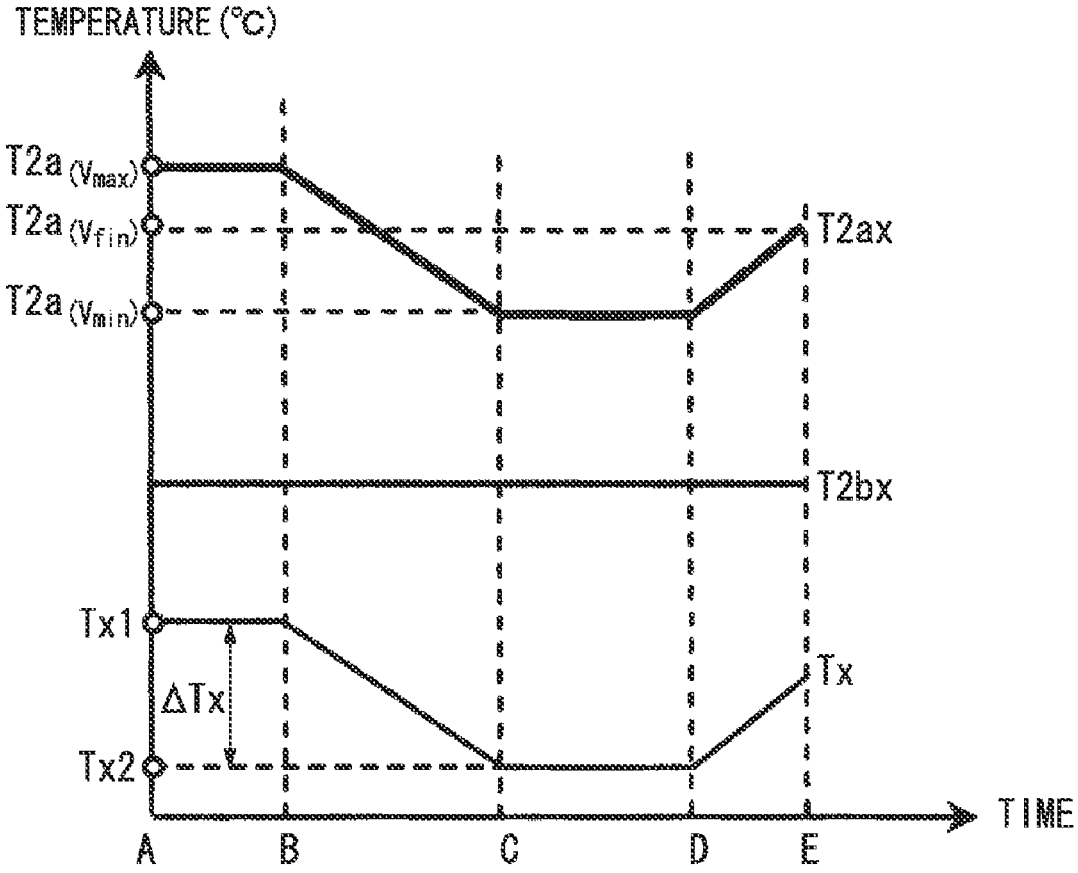
FIG. 5 is a schematic view of a temperature history during the cooling process.

During a continuous cooling process in which the transportation speed transitions to the second transportation speed, the transportation speed changes with the advancement of the finishing rolling, as illustrated in FIG. 3. On the other hand, the amount Tx of cooling in the second cooling section 20 (in other words, T2*ax*−T2*bx*) varies as illustrated in FIG. 5 in the case where T2*ax* and the cooling conditions in the second cooling section (cooling length and the cooling water amount density) remain unchanged, and a difference of the amount of cooling can be expressed as ΔTx (in other words, Tx1−Tx2) during the transition to the second transportation speed. Therefore, at the time of transitioning from the first transportation speed to the second transportation speed, it is necessary to set the target temperature of the steel strip on the input side in the second cooling section and perform adjustment by controlling the water supplied in the first cooling section, by taking the amount of change in Tx into consideration. Setting described above is made by considering the control accuracy in the cooling section 1 in the range that falls within $0.8 \leqq (T2a'-T2a)/\Delta Tx \leqq 1.2$, desirably, $0.9 \leqq (T2a'-T2a)/\Delta Tx \leqq 1.1$, where T2*a* is the target temperature of the steel strip on the input side in the second cooling section at the first transportation speed, and T2*a*' is the target temperature of the steel strip on the input side in the second cooling section after the transportation speed becomes the second transportation speed. The target temperature T2*a*" of the steel strip on the input side in the second cooling section during the transition from the first transportation speed to the second transportation speed can be expressed as a function of time based on the T2*a* and the T2*a*'. For example, the function can be given as values associated with time, by using the time required for transitioning from the first transportation speed to the second transportation speed, and the average amount of change in temperatures per unit time ((T2*a*'−T2*a*)/t). Further, in FIG. 3, in the case where the first transportation speed is a transportation speed at time A and the second transportation speed is a transportation speed at time B, the transportation speed is constant during the transition from the time A to the time B, and hence, ΔTx is zero in this transition. Therefore, T2*a*=T2*a*' is established during the transition from the time A to the time B. The supplying of the water is controlled in the cooling section 1 so as to be the set T2*a*', and the steel strip is cooled in the second cooling section in a state where the cooling conditions such as the cooling length and/or the water amount density are substantially constant. Note that the wording "substantially constant" means that the amount of change in the cooling length falls within the range of 90% to 110%, and the amount of change in the water amount density falls within the range of 80% to 120%. Further, in a similar manner, in the case where the transportation speed schedule is obtained with respect to the longitudinal direction of the steel strip, it is possible to set a new target steel strip temperature T2*a*' so as to be associated with positions in the longitudinal direction of the steel strip.

Since cooling in the film boiling range is performed in the first cooling section 10, it is possible to precisely achieve the temperature of the steel strip on the input side in the second cooling section by controlling the supplying of the water in accordance with the change in the transportation speed, and to make the cooling length and the cooling water amount density of the second cooling unit 20*a* almost unchanged in the second cooling section 20. This makes it possible to: remove the external cooling disturbance caused by entry of the water existing on the steel strip resulting from ON/OFF of the water-supplying valve; suppress the deviation of the temperature of the steel strip on the output side in the second cooling section; and precisely achieve the coiling temperature of the steel strip.

Figure 6:
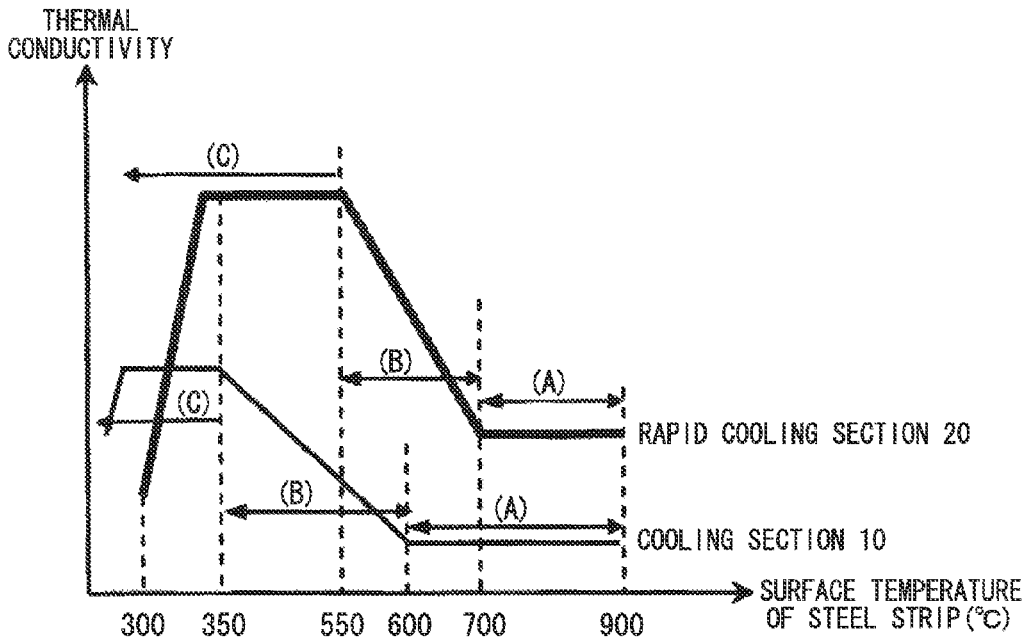
FIG. 6 is a schematic view illustrating a mode of cooling a steel strip.

The temperature range in which the cooling conditions are constant in the second cooling section may be set in the range of 300° C. to 700° C., and more desirably, in the range of 400° C. to 600° C. This is because it is possible to further reduce the deviation of the coiling temperature of the steel strip by reducing the time required for cooling under the transition boiling in the second cooling section. As illustrated in FIG. 6, in the case where the water amount density in the second cooling section 20 is 3 $m^3/min/m^2$ and the water amount density in the first cooling section 10 is 0.3 $m^3/m^2/min$, cooling under the transition boiling (B) starts at steel strip temperatures of about 700° C. and about 600° C., respectively, and cooling under the film boiling (A) is performed in the range of the steel strip temperatures higher than those temperatures. With the cooling under the film boiling, it is possible to obtain a stable cooling capacity (heat transfer coefficient), independently of the steel strip temperatures. On the other hand, with the cooling under the transition boiling, the deviation of the temperatures of the steel strip increases, because the cooling capacity sharply increases due to a decrease in the steel strip temperature, which further accelerates cooling in the lower temperature portions.

Therefore, by cooling, in the first cooling section 10, the steel strip to the lowest temperature (600° C.) at which cooling is performed under the film boiling and then, performing the rapid cooling in the second cooling section 20, it is possible to reduce the time required for cooling under the transition boiling in the second cooling section, whereby it is possible to reduce the variation in cooling caused by performing the cooling under the transition boiling state. With this process, it is possible to stably obtain the steel strip temperature on the output side in the second cooling section, whereby it is possible to further reduce the deviation of the coiling temperature of the steel strip.

The mode of cooling the steel strip illustrated in FIG. 6 will be described in a more detail. In the case where the temperature of the steel strip is higher than 700° C. and the rapid cooling is performed with the water amount density of 3 $m^3/min/m^2$, cooling of the steel strip is performed under the film boiling (A) under which the capacity of cooling the steel strip (heat transfer coefficient) is small. Therefore, the flow of the cooling water on the steel strip and the change in the cooling length, which does not follow the change in the transportation speed, have a small impact on the deviation of the coiling temperature of the steel strip. Further, rapid cooling in the temperature range lower than 300° C. does not provide sufficient effects if the amount of investment in the facilities is compared with the thus obtained effect in terms of material properties. In general, rapid cooling of the steel strip in the temperature range of 300° C. to 700° C. provides an advantage in obtaining predetermined material properties. However, in this temperature range, the steel strip is cooled under the transition boiling (B) and the nucleate boiling (C). In the transition boiling, capacity of cooling the steel strip sharply increases with decrease in the steel strip temperature, whereas cooling under the nucleate boiling state provides five to almost 10 times larger cooling capacity than that obtained in the film boiling state when performed with the same amount of water. More specifically, the flow of the cooling water on the steel strip, and the change in the cooling length, which does not follow the change in the transportation speed, have a large impact on the uniformity of the coiling temperatures of the steel strip, and hence, it is important to prevent the occurrence of the flow of the cooling water on the steel strip and change in the cooling length in this temperature range in order to improve the uniformity of the coiling temperatures of the steel strip.

At the time when the cooling conditions in the second cooling section 20 are determined, it may be possible to determine the cooling length on the basis of the maximum value of the transportation speed in the transportation-speed changing schedule, and set the initial value of the target temperature T2*a* of the steel strip on the input side in the second cooling section on the basis of the minimum value of the transportation speed in the transportation-speed changing schedule. An example thereof includes a case where the temperature of the steel strip on the input side in the second cooling section 20 in the continuous cooling is desired to be a certain value or more.

Next, description will be made of a method for setting the initial cooling conditions in the second cooling section 20 by determining the cooling length on the basis of the maximum value of the transportation speed in the transportation speed schedule, and setting an initial value of the target temperature T2*a* of the steel strip on the input side in the second cooling section on the basis of the minimum value of the transportation speed. In FIG. 3, the transportation speed increases and decreases in an approximate straight line by accelerating and decelerating from the front end to the rear end of the steel strip. In FIG. 3, the minimum value of the transportation speed is denoted by V(min), the maximum value is denoted by V(max), and the speed at the end of finishing rolling is denoted by V(fin).

As described above, for example, the amount of cooling in the second cooling section 20 is T2*a*−T2*b*=120° C. in the case where the target coiling temperature T4 of the steel strip is set to 450° C., the target temperature T2*b* of the steel strip on the output side in the second cooling section 20 is set to 480° C., and the target temperature T2*a* of the steel strip on the input side in the second cooling section 20 is set to 600° C. For the transportation speed of the steel strip, V(min) is 400 mpm, V(max) is 600 mpm and V(fin) is 520 mpm, for example. As the initial settings of the cooling conditions in the second cooling section 20 under which the cooling of 120° C. can be achieved at the time when the steel strip is transported at 600 mpm, the amount of cooling water is set, for example, to 3 $m^3/min/m^2$, and the cooling length is set to 3 m.

In the case where cooling is performed under the cooling conditions described above, the time required for the cooling is 1.5 times longer at the time of the transportation speed being 400 mpm, which is the minimum value. Therefore, the amount of cooling increases by about 60° C., so that the amount of cooling in the second cooling section 20 is about 180° C. Since it is desirable to set the temperature T2*b* of the steel strip on the output side in the second cooling section 20 to be constant, the initial setting of the target temperature T2*a* of the steel strip on the input side in the second cooling section 20 is set to 660° C., which is 60° C. higher than 600° C.

In the acceleration section, the amount of cooling T2*a*-T2*b* in the second cooling section 20 decreases, and hence, in response to the acceleration, the target temperature T2*a*' of the steel strip on the input side in the second cooling section is made decreased from the temperature of 660° C. in accordance with the change in the transportation speed. Then, at the time when the transportation speed reaches the maximum speed, the target temperature T2*a*' of the steel strip on the input side in the second cooling section 20 is 600° C.

When the finishing rolling further advances and enters the deceleration section, the amount of cooling T2*a* –T2*b* in the second cooling section 20 increases, and thus, the target temperature T2*a* of the steel strip on the input side in the second cooling section is made increased again from 600° C. Since the speed V(fin) at the end of the rolling is V(min)<V(fin)<V(max), the relationship at the input side of the second cooling section 20 between the target steel strip temperature $T2a_{(Vmax)}$ at the maximum speed, the target steel strip temperature $T2a_{(Vmin)}$ at the minimum speed and the target steel strip temperature $T2a_{(Vfin)}$ at the end of the rolling is $T2a_{(Vmax)}<T2a_{(Vfin)}<T2a_{(Vmin)}$.

As described above, the cooling conditions in the second cooling section 20 are set such that the cooling length is determined on the basis of the maximum value of the transportation speed, and the initial value of the target temperature T2*a* of the steel strip on the input side in the second cooling section is set on the basis of the minimum value of the transportation speed. With this setting, the target temperature T2*a* of the steel strip on the input side in the second cooling section can be made always higher than the T2*a*(ini), which is the initial setting value, in the continuous cooling process in which the transportation speed varies. In the case where the cooling of the second cooling section is started from a temperature in the vicinity of the temperature at which cooling under the transition boiling in the first cooling section 10 is started, it is possible to avoid the cooling under the transition boiling in the first cooling section 10.

In the second cooling section 20, cooling is performed with the cooling length and/or the water amount density being constant independently of the transportation speed; in the first cooling section 10 and the third cooling section 30, water supplying is controlled on the basis of the transportation speed by opening and closing the valve, to cool the steel strip so as to be a predetermined coiling temperature of the steel strip; and then, the steel strip is coiled by the coiler.

For controlling the water supplying in the first cooling section 10 and the third cooling section 30, it is desirable that the thermometers be provided on the input side and the output side of the second cooling section 20, and that the feedback control and the feed-forward control be performed by using the values from the thermometers. By using the actually measured steel strip temperatures in controlling, it is possible to precisely achieve the target temperature T2*a* of the steel strip on the input side in the second cooling section, and the coiling temperature of the steel strip.

At the time of determining the cooling conditions in the second cooling section, it may be possible to determine the cooling water amount density in advance, and then, obtain the cooling length such that the required amount of cooling T2*a*–T2*b* can be achieved. For example, it may be possible to designate in advance certain types of steels as steels to be cooled with the cooling water amount density of 3 $m^3/min/m^2$, and then, to determine the cooling length.

In the second cooling section, it is possible to perform cooling with the cooling water amount and the cooling length with which the cooling under the nucleate boiling range accounts for 80% or more. This makes it possible to suppress the variation in temperatures caused by the cooling under the transition boiling, and to cool the target in a uniform manner.

The second cooling section may be divided into a front cooling section, a middle cooling section, and a rear cooling section. In this case, the temperatures of the steel strip on the output side are measured on the output side of the front cooling section. On the basis of the measured output-side steel strip temperature in the front cooling section, the cooling conditions in the middle cooling section are changed, and the steel temperature on the input side of the rear cooling section is controlled so as to fall within a predetermined range, whereby it is possible to further favorably suppress the deviation of the coiling temperature of the steel strip.

In the third cooling section 30, it may be possible to perform cooling with the water amount density of the cooling water in the range of 0.05 $m^3/min/m^2$ to 0.15 $m^3/min/m^2$. Cooling in the third cooling section 30 may be performed by supplying cooling water as the cooling medium, gas or a mixture thereof, as well as by air cooling in which no cooling medium is supplied. This is because, by reducing the water amount density, it is possible to improve the controllability in cooling, whereby it is possible to precisely achieve the coiling temperature of the steel strip.

EXAMPLES

Next, a description will be made of Examples A1 to A7, Examples B1 to B7, Examples of C1 to C7, and Examples D1 to D7, each of which employs the finishing rolling mill, the first cooling unit, the second cooling unit, and the coiler.

Figure 7:
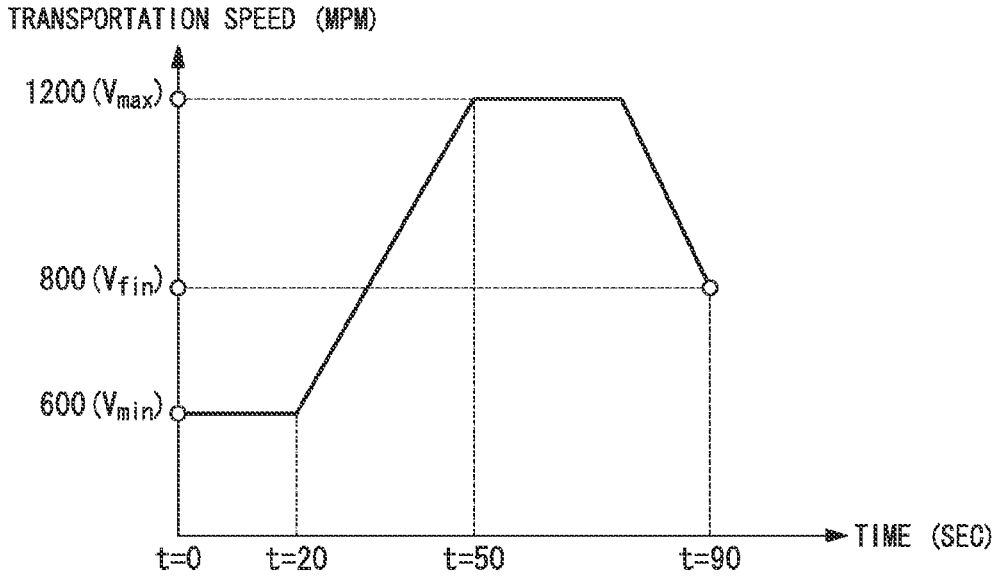
FIG. 7 is a diagram illustrating a transportation-speed changing schedule used in an example.

In each of Examples, a hot-rolled steel strip was subjected to finishing rolling in accordance with the transportation-speed changing schedule illustrated in FIG. 7, and then, subjected to the first cooling and the second cooling. Table 1 shows cooling conditions and evaluation results of Examples. In FIG. 7, t=0 indicates a time when the top end portion of the hot-rolled steel strip reaches the first cooling section, and t=90 indicates a time when the rear end portion of the hot-rolled steel strip reaches the coiler. In the present Examples, evaluation was made by setting the first transportation speed to be a transportation speed at t=20, and setting the second transportation speed to be a transportation speed at t=50. It should be noted that the target temperature of the steel strip on the output side in the second cooling section is set at 400° C.

TABLE 1

| | Target temperature T2a of steel strip on input side in second cooling section at t = 20 ° C. | Cooling amount Tx1 in second cooling section at t = 20 ° C. | Cooling amount Tx2 in second cooling section at t = 50 ° C. | Change amount ΔTx of cooling amount in second cooling section between t = 20 to t = 50 ° C. | (T2a' − T2a)/(ΔTx) | Target temperature T2a' of steel strip on input side in second cooling section at t = 50 ° C. | Deviation of temperature of steel strip on input side in second cooling section |
|---|---|---|---|---|---|---|---|
| Example A1 | 700 | 200 | 100 | 100 | 0.7 | 630 | 9.6 |
| Example A2 | | | | | 0.8 | 620 | 9.8 |
| Example A3 | | | | | 0.9 | 610 | 9.4 |
| Example A4 | | | | | 1 | 600 | 9.5 |
| Example A5 | | | | | 1.1 | 590 | 9.6 |
| Example A6 | | | | | 1.2 | 580 | 9.7 |
| Example A7 | | | | | 1.3 | 570 | 9.6 |
| Example B1 | 700 | 200 | 100 | 100 | 0.7 | 630 | 9.7 |
| Example B2 | | | | | 0.8 | 620 | 9.9 |
| Example B3 | | | | | 0.9 | 610 | 9.6 |
| Example B4 | | | | | 1 | 600 | 9.8 |
| Example B5 | | | | | 1.1 | 590 | 9.8 |
| Example B6 | | | | | 1.2 | 580 | 9.9 |
| Example B7 | | | | | 1.3 | 570 | 9.7 |
| Example C1 | 700 | 200 | 100 | 100 | 0.7 | 630 | 9.8 |
| Example C2 | | | | | 0.8 | 620 | 9.9 |
| Example C3 | | | | | 0.9 | 610 | 9.7 |
| Example C4 | | | | | 1 | 600 | 9.6 |
| Example C5 | | | | | 1.1 | 590 | 9.6 |
| Example C6 | | | | | 1.2 | 580 | 9.9 |
| Example C7 | | | | | 1.3 | 570 | 9.8 |
| Example D1 | 700 | 200 | 100 | 100 | 0.7 | 630 | 9.6 |
| Example D2 | | | | | 0.8 | 620 | 9.9 |
| Example D3 | | | | | 0.9 | 610 | 9.7 |
| Example D4 | | | | | 1 | 600 | 9.6 |
| Example D5 | | | | | 1.1 | 590 | 9.7 |
| Example D6 | | | | | 1.2 | 580 | 9.9 |
| Example D7 | | | | | 1.3 | 570 | 9.8 |

| | Deviation of coiling temperature of steel strip | Water amount density in second cooling section at t = 20 $m^3/min/m^2$ | Water amount density in second cooling section at t = 50 $m^3/min/m^2$ | Cooling length in second cooling section at t = 20 m | Cooling length in second cooling section at t = 50 m | Range of variation in cooling length in second cooling section (Ratio) |
|---|---|---|---|---|---|---|
| Example A1 | 14.6 | 3.0 | 3.0 | 6.0 | 6.9 | 1.15 |
| Example A2 | 13.2 | | | | 6.6 | 1.1 |
| Example A3 | 12.9 | | | | 6.3 | 1.05 |
| Example A4 | 12.7 | | | | 6.0 | 1 |
| Example A5 | 12.9 | | | | 5.7 | 0.95 |
| Example A6 | 13.2 | | | | 5.4 | 0.9 |
| Example A7 | 14.4 | | | | 5.1 | 0.85 |
| Example B1 | 14.9 | 2.0 | 2.0 | 8.4 | 9.7 | 1.15 |
| Example B2 | 13.8 | | | | 9.2 | 1.1 |
| Example B3 | 13.4 | | | | 8.8 | 1.05 |
| Example B4 | 13.1 | | | | 8.4 | 1 |
| Example B5 | 13.6 | | | | 8.0 | 0.95 |
| Example B6 | 13.9 | | | | 7.6 | 0.9 |
| Example B7 | 15.1 | | | | 7.1 | 0.85 |
| Example C1 | 15.8 | 1.5 | 1.5 | 10.5 | 12.1 | 1.15 |
| Example C2 | 15.3 | | | | 11.6 | 1.1 |
| Example C3 | 14.9 | | | | 11.0 | 1.05 |
| Example C4 | 14.7 | | | | 10.5 | 1 |
| Example C5 | 15.1 | | | | 10.0 | 0.95 |
| Example C6 | 15.5 | | | | 9.5 | 0.9 |
| Example C7 | 16.2 | | | | 8.9 | 0.85 |
| Example D1 | 14.8 | 3.0 | 4.4 | 6.0 | 6.0 | 1.45 |
| Example D2 | 13.3 | | 3.9 | | | 1.30 |
| Example D3 | 12.9 | | 3.4 | | | 1.15 |
| Example D4 | 12.5 | | 3.0 | | | 1.00 |
| Example D5 | 13.1 | | 2.6 | | | 0.87 |
| Example D6 | 13.3 | | 2.3 | | | 0.77 |
| Example D7 | 14.9 | | 2.1 | | | 0.69 |

In Table 1, the "deviation of temperature of steel strip on input side in second cooling section" and the "deviation of coiling temperature of steel strip" each refer to deviation of temperatures obtained by continuously measuring temperatures of the center of the width of the steel strip in the direction in which the steel strip moves.

In the present Examples, since the steel strip was air cooled from the output of the second cooling section to the coiling, the deviation of the steel strip temperature on the output side of the second cooling section is considered to be almost equal to the deviation of the coiling temperature of the steel strip.

The results of these Examples confirm that the effect of suppressing the deviation of the coiling temperature of the steel strip can be obtained by setting the target temperature T2*a*' of the steel strip on the input side in the second cooling section such that the value of (T2*a*'−T2*a*)/ΔTx falls in the range of 0.8 to 1.2.

Furthermore, the results of Examples C1 to C7, which are comparative examples, confirm that, even by setting the target temperature T2*a*' of the steel strip on the input side in the second cooling section such that the value of (T2*a*'−T2*a*)/ΔTx falls in the range of 0.8 to 1.2, the effect of suppressing the deviation of the coiling temperature of the steel strip cannot be obtained in the case where the water amount density in the second cooling section is lower than 2.0 $m^3/min/m^2$.

As described above, the preferred embodiment of the present invention has been described with reference to the attached drawings. However, the present invention is not limited to the examples. Apparently, the skilled person in the art can reach various change examples or modification examples within the scope of the Claimed technical principle. It is understood that these example changes or modification examples are naturally included in the technical scope of the present invention.

Industrial Applicability

According to the present invention, it is possible to precisely and uniformly cool a hot-rolled steel strip transported from a finishing rolling mill at a transportation speed with acceleration and deceleration, to achieve a predetermined coiling temperature of the steel strip.

Reference Signs List

1 Cooling device
2 Finishing rolling mill
3 Coiler
4 Run-out table
4*a* Table roll
10 First cooling section
10*a* First cooling unit
11 Laminar nozzle
20 Second cooling section (rapid cooling section)
20*a* Second cooling unit (rapid cooling unit)
21 Spray nozzle (on the upper surface side)
30 Third cooling section
30*a* Third cooling unit
40 Control unit
51, 52, 53, 54, 55 Thermometer
S Steel strip
V(min) Minimum transportation speed
V(max) Maximum transportation speed
V(fin) Transportation speed at the end of finishing rolling
T2*a*(Vmin) Target temperature of steel strip on the input side of second cooling section at minimum transportation speed
T2*a*(Vmax) Target temperature of steel strip on the input side of second cooling section at maximum transportation speed
T2*a*(Vfin) Target temperature of steel strip on the input side of second cooling section with respect to a transportation speed at the end of finishing rolling
(A) Cooling under film boiling
(B) Cooling under transition boiling
(C) Cooling under nucleate boiling

The invention claimed is:

1. A method for cooling a hot-rolled steel strip after a finishing rolling in which a transportation speed varies, the method including:

setting a transportation-speed changing schedule based on a temperature of a steel strip before the finishing rolling and a condition of the finishing rolling;

performing a first cooling in which the hot-rolled steel strip is cooled under a film boiling state in a first cooling section;

performing a second cooling in which the hot-rolled steel strip is cooled with a water amount density of not less than 2 $m^3/min/m^2$ in a second cooling section; and coiling the hot-rolled steel strip, wherein a cooling condition is controlled in the first cooling such that a target temperature T2*a* of the steel strip on an input side in the second cooling section before a change in a speed of rolling, a target temperature T2*a*' of the steel strip on an input side in the second cooling section after a change in the speed of rolling, and a change amount ΔTx of an amount of cooling the hot-rolled steel strip in the second cooling section, the change amount being caused by the change in the speed of rolling, satisfy $$0.8 \leqq (T2a' - T2a)/\Delta Tx \leqq 1.2 \quad \text{(Equation 1).}$$

2. The method for cooling a hot-rolled steel strip according to claim 1, wherein a range of variation in a cooling length in the second cooling section is in the range of 90% to 110% independently of change in the transportation speed.

3. The method for cooling a hot-rolled steel strip according to claim 1, wherein a range of variation in the water amount density in the second cooling section is in the range of 80% to 120% independently of change in the transportation speed.

4. The method for cooling a hot-rolled steel strip according to claim 1, wherein cooling under a nucleate boiling state accounts for not less than 80% of cooling duration in the second cooling section.

5. The method for cooling a hot-rolled steel strip according to claim 1, the method further including:

performing a third cooling in a third cooling section disposed after the second cooling section, the third cooling being formed by cooling with a cooling water of water amount density of not less than 0.05 $m^3/min/m^2$ and not more than 0.15 $m^3/min/m^2$ and cooling with outside air.

6. The method for cooling a hot-rolled steel strip according to claim 1, the method further including:

setting a cooling length in the second cooling section based on a maximum value of the transportation speed in the transportation-speed changing schedule; and setting the target temperature T2*a* of the steel strip on the input side in the second cooling section based on a minimum value of the transportation speed in the transportation-speed changing schedule.

7. The method for cooling a hot-rolled steel strip according to claim 6, wherein a range of variation in the water amount density in the second cooling section is in the range of 80% to 120% independently of change in the transportation speed.

8. The method for cooling a hot-rolled steel strip according to claim 6, wherein cooling under a nucleate boiling state accounts for not less than 80% of cooling duration in the second cooling section.

9. The method for cooling a hot-rolled steel strip according to claim 6, wherein the method further includes:

measuring an input-side temperature of the steel strip on the input side in the second cooling section; and changing the cooling condition in the first cooling section based on the measured input-side temperature of the steel strip, and controlling the input-side temperature of the steel strip so as to fall within a predetermined range.

10. The method for cooling a hot-rolled steel strip according to claim 9, wherein the method further includes:

measuring an output-side temperature of the steel strip on the output side in the second cooling section; and changing a cooling condition in a third cooling section disposed after the second cooling section on the basis of the measured output-side temperature of the steel strip, and controlling a coiling temperature of the steel strip to fall within a predetermined range.

11. The method for cooling a hot-rolled steel strip according to claim 6, wherein the method further includes:

measuring an output-side temperature of the steel strip on the output side in the second cooling section; and changing a cooling condition in a third cooling section disposed after the second cooling section on the basis of the measured output-side temperature of the steel strip, and controlling a coiling temperature of the steel strip to fall within a predetermined range.

12. The method for cooling a hot-rolled steel strip according to claim 1, the method further including:

measuring an input-side temperature of the steel strip on the input side in the second cooling section; and changing the cooling condition in the first cooling section based on the measured input-side temperature of the steel strip, and controlling the input-side temperature of the steel strip so as to fall within a predetermined range.

13. The method for cooling a hot-rolled steel strip according to claim 12, wherein a range of variation in the water amount density in the second cooling section is in the range of 80% to 120% independently of change in the transportation speed.

14. The method for cooling a hot-rolled steel strip according to claim 12, wherein cooling under a nucleate boiling state accounts for not less than 80% of cooling duration in the second cooling section.

15. The method for cooling a hot-rolled steel strip according to claim 12, wherein the method further includes:

measuring an output-side temperature of the steel strip on the output side in the second cooling section; and changing a cooling condition in a third cooling section disposed after the second cooling section on the basis of the measured output-side temperature of the steel strip, and controlling a coiling temperature of the steel strip to fall within a predetermined range.

16. The method for cooling a hot-rolled steel strip according to claim 1, the method further including:

measuring an output-side temperature of the steel strip on the output side in the second cooling section; and changing a cooling condition in a third cooling section disposed after the second cooling section on the basis of the measured output-side temperature of the steel strip, and controlling a coiling temperature of the steel strip to fall within a predetermined range.

17. The method for cooling a hot-rolled steel strip according to claim 16, wherein a range of variation in the water amount density in the second cooling section is in the range of 80% to 120% independently of change in the transportation speed.

18. The method for cooling a hot-rolled steel strip according to claim 16, wherein cooling under a nucleate boiling state accounts for not less than 80% of cooling duration in the second cooling section.

19. The method for cooling a hot-rolled steel strip according to claim 1, wherein the second cooling section includes a front cooling section, a middle cooling section, and a rear cooling section, and the method further includes:

measuring an output-side temperature of the steel strip on an output side of the front cooling section; and changing a cooling condition in the middle cooling section based on the measured output-side temperature of the steel strip in the front cooling section, and controlling the temperature of the steel strip on an input side of the rear cooling section to fall within a predetermined range.

* * * * *